United States Patent [19]

Pope

[11] 4,419,840

[45] Dec. 13, 1983

[54] MODULAR MODEL STRUCTURE

[76] Inventor: Benjamin D. Pope, 831 Jewell, Ferndale, Mich. 48220

[21] Appl. No.: 294,512

[22] Filed: Aug. 20, 1981

[51] Int. Cl.[3] ..... A63H 33/06

[52] U.S. Cl. ..... 46/19

[58] Field of Search ..... 46/12, 16, 19, 21, 23, 46/24, 25, 26, 17

[56] References Cited

U.S. PATENT DOCUMENTS

| | | | |
|---|---|---|---|
| 1,061,637 | 5/1913 | Schwarz | 46/19 |
| 3,691,672 | 9/1972 | Pendill | 46/16 |
| 3,736,697 | 6/1973 | Keces | 46/17 |
| 3,946,516 | 3/1976 | Wirth | 46/17 |

FOREIGN PATENT DOCUMENTS

| | | | |
|---|---|---|---|
| 2604428 | 8/1977 | Fed. Rep. of Germany | 46/19 |

OTHER PUBLICATIONS

Popular Mechanics, Kings Castle, Nov. 1962, pp. 162, 163.

*Primary Examiner*—Gene Mancene
*Assistant Examiner*—Kris R. Schulze
*Attorney, Agent, or Firm*—Hauke and Patalidis

[57] ABSTRACT

A modular model building structure comprising an integrally-formed base and a plurality of modular units. The modular units are formed so as to fixedly contact with the base with other modular units of the model structure. Further, the modular units are interchangeable, in part, thereby allowing the model structure to be arranged in several alternative configurations.

16 Claims, 7 Drawing Figures

FIG. 1
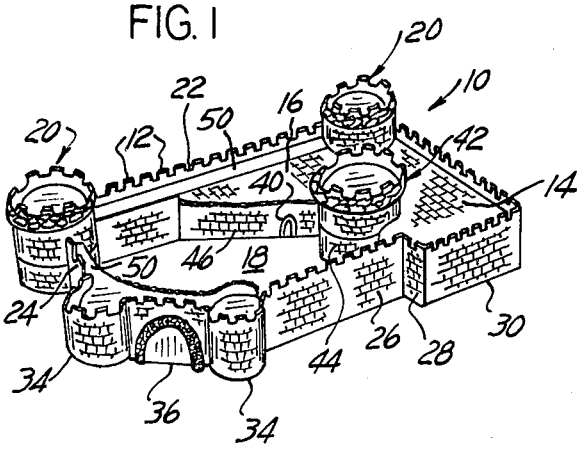
FIG. 5
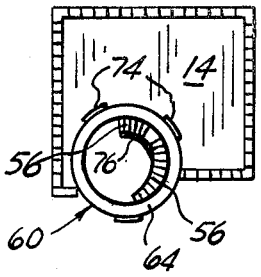
FIG. 2
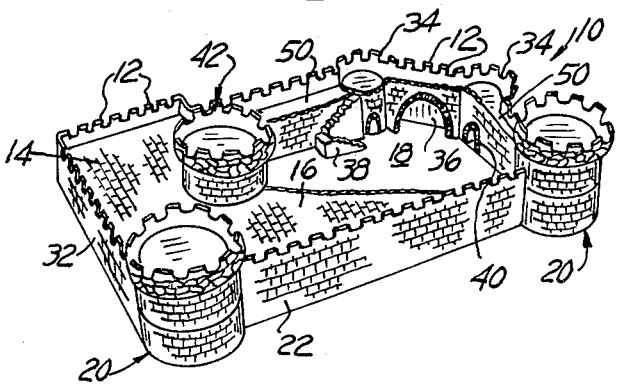
FIG. 3
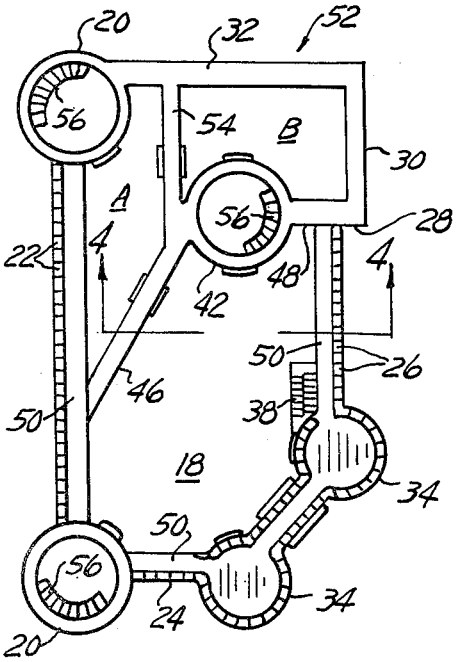
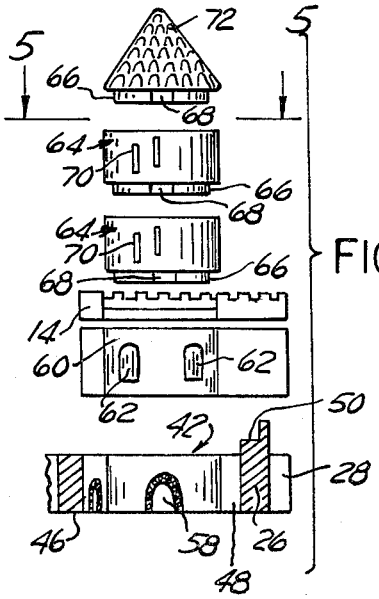
FIG. 4

MODULAR MODEL STRUCTURE

BACKGROUND OF THE INVENTION

The invention relates to a model structure of modular components. In the example illustrated, the invention is applied to a model medieval castle, and more particularly, to a castle suitable for use in games where medieval battles are recreated.

This type of game is currently very popular and there are several model castles already on the market for this purpose. However, these models all have the disadvantage of being made of one piece, or having parts which cannot be arranged in many alternative configurations. The present invention overcomes this disadvantage by providing for a castle with a plurality of interchangeable modular units, which extend greatly the number of arrangements in which the castle can be made for use in a game.

Furthermore, present model structures on the market, for example, model castles, as presently available, fail to provide for compartments in which other model units, such as soldiers, can be stored. This is significant because one object of the typical game using model castles is to surprise an opponent with reserves of soldiers hidden in compartments which he or she did not expect upon attacking the model castle. The present invention, as illustratd in castle form, provides for more than adequate compartment space in two separate stronghold areas, together with compartment space available in towers located at two corners of the model castle and within the castle keep.

BRIEF DESCRIPTION OF THE DISCLOSURE

FIG. 1 is a front top perspective view of an assembly of modular units according to the present invention;

FIG. 2 is a rear top perspective view thereof;

FIG. 3 is a top plan view of an integrally-formed base according to the present invention with the modular units shown at FIG. 1 removed;

FIG. 4 is a front elevational exploded view from line 4—4 of FIG. 3 and showing a plurality of modular units assembled above one section of the integrally-formed base;

FIG. 5 is a top plan view of the assembled modular unit from line 5—5 of FIG. 4;

DETAILED DESCRIPTION OF THE PREFERRED EMBODIMENT

Figure 6:
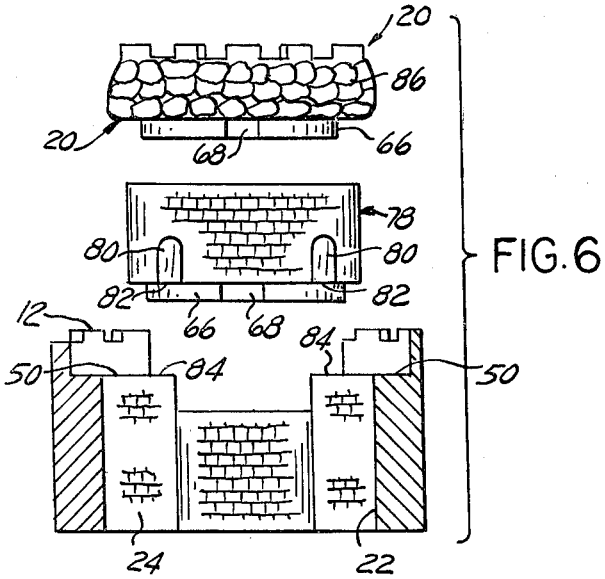
FIG. 6 is a front elevational exploded view showing a further plurality of modular units assembled above another section of the integrally-formed base.

Referring now to FIGS. 1 and 2, there is shown an example of an assemblage of modular units according to the present invention, being in the form of a castle for the purpose of illustration. This castle assembly 10 has around its periphery a battlement 12 consisting of crenellated parapet with merlons spaced an equal distance apart.

The assembly 10, as shown, is comprised of two roof areas 14, 16, a forward courtyard area 18, two towers 20 disposed along the periphery of the castle, peripheral walls 24, 26, 28, 30, 32, and being further comprised of two gate towers 34 disposed between walls 24, 26 and having a drawbridge 36 disposed between the towers 34. In addition, a stairway 38 leads from the forward courtyard 18 to the gate tower 34 disposed nearest the wall 26. Several doors 40 are placed along the walls of the assembly 10 for the purpose of adding authenticity to the appearance of the castle. Finally, a keep 42 is disposed between the two sections of roof 14, 16, the keep 42 further having a base 44 formed integrally with two interior walls 46 and 48 (wall 48 is shown in FIG. 3).

There is a chemin de ronde 50 (gangway) surrounding most of the periphery of the assembly 10. Particularly, the chemin de ronde 50 runs along the top of walls 22, 24, and 26. The chemin de ronde also crosses the towers 20, 34.

Referring now to FIG. 3, the base 52 of the structure 10, as illustrated as a castle, is shown in top plan with the upper modular units of the towers 20 and the keep 42 removed. The base further comprises integrally formed walls 20, 24, 26, 28, 30, 32, 46, 48 and 54. There is formed by the integrally molded base 52 two compartments, A and B, for the purpose of storing therein and being hidden from view, certain other pieces (not shown) for the situation where the present invention is used in a game. Compartment A is formed between the walls 22, 46, 54, and 32. Compartment B is formed between the walls 48, 54, 32, and 30.

FIG. 3 further illustrates that within the base of the towers 20 there is located a projection 56 winding down the interior wall. For the purposes of the present illustration, this projection is a staircase 56 which adds to the realism of a castle tower 20 and further provides a means for interlocking further modules as fully described hereafter.

FIG. 4 is a front elevational exploded view of a section of the base through lines 4—4 of FIG. 3 and shown with further modular units disposed above. The area of the structure being the keep 42 is shown in position between the two integrally formed walls 46, 48 and the chemin de ronde 50 running along the top of the abutting wall 26. Further, the keep 42 is shown as having a door 58 for the purpose of access to the tower structure.

Disposed immediately above the keep 42 is a modular unit 60 which can be placed thereon. This modular unit is similar to the corresponding portion of the base 52 and rests upon the flat upper surfaces of walls 48, 30, 32 and 54 (FIG. 3). The difference between the modular unit 60 and the keep 42 is the presence of two lancet windows 62 substituted for the door 58.

Not shown as part of the modular unit 60, but located therein, is the stairway 56 as shown within the towers 20, 42 of FIG. 3. This staircase, as more fully explained hereinafter, provides for the interlocking of the further modular units.

The roof 14 is shown in FIG. 4 as disposed above the intermediate modular unit 60. In FIG. 1, this roof 14 is shown in position over the keep 42 without the intervening modular unit. It can be seen that this interchangeability increases the configurations in which the castle can be formed.

A further modular unit 64 is shown in FIG. 4 as disposed above the roof 14. This modular unit 64 also has a staircase therein, not shown, for the purpose of interlocking. Further, the modular unit 64 has a reduced diameter portion 66 so that modular unit 64 can be fitted through the roof 14 and within the modular unit 60. So fitted, a notch 68 in the reduced diameter portion 66 fits over the staircase in modular unit 60 and fixes unit 64 in position. Concurrently, the roof is affixed in one position by the presence of the module 64 within the module 60 as more fully explained hereafter.

An additional module 64, being identical to the module 64 disposed beneath it, is shown at FIG. 4 to illustrate that a structure according to the present invention can be made in a variety of configurations. The second module 64, having an identical reduced diameter portion 66 with a notch 68, can be fitted at the top of the underlying module 64 so that its notch 68 fits over the staircase 56 within the underlying module 64 and affixes them together.

FIG. 4 further shows a conical roof 72 with imbricated tile molded thereon. This roof 72 also has a reduced diameter portion 68 for fitting within the modular unit 64 disposed beneath it. It will be appreciated that in the example of keep 42 shown in FIG. 1 there is a roof having a cranal configuration. However, with the present invention, any variety of roofs with an appropriate reduced diameter portion 68 can be used with the structure 10.

FIG. 5 is a top plan view of the assembled modular units through line 5—5 of FIG. 4. As shown, two doors 74, or windows as the case may be, are shown as overhanging the roof 14 of the keep 12. The purpose of this overhang is to further lock the roof 14 in a fixed position.

FIG. 5 also shows that there is a slot 76 through which the staircase 56 of the modular unit 60 can be seen. In a model castle, for example, this slot 76 is necessary for access from the staircase 56 in the modular unit 64 to the staircase 56 in the modular unit 60.

Referring now to FIG. 6, there is shown a front elevational view in exploded form of one example of a tower 20 according to the present invention. The tower illustrated is the one disposed between walls 22 ad 24 of the structure 10, both having the chemin de ronde 50 running along the top.

The modular middle section 78 is shown having two doorways 80 molded in the exterior surface of the section 78 at such a distance apart from each other, and protruding from the modular section 78 at such a width, that when the bottom 82 of the doors is placed in communication with the end 84 of the chemin de ronde 50, the doors fit snugly in the end 84 and rest against the crenellated parapet 12 so that the module 78 is affixed firmly and prevented from being accidentally rotated.

It will be appreciated that the modular unit 78 is also locked in, according to the present invention as heretofore described, by inserting a reduced diameter portion 66 with a notch 68 over a staircase, not shown, located in the base of the tower 20. A further module 86, disposed above the middle module 78, also has a reduced diameter portion 66 with a notch 68 for fitting over a staircase within the intervening module 78, not shown.

Figure 7:
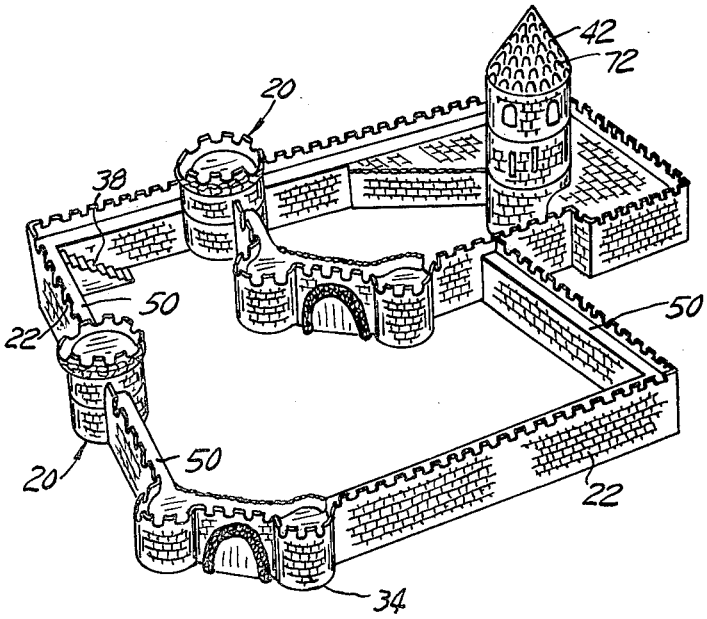
FIG. 7 is a front perspective view of an assembly of modular units according to the present invention.

FIG. 7 shows a view similar to FIG. 1, but having additional modular units added to the configuration. For example, the keep 42, is shown as having two intervening modular units as opposed to one in FIG. 1.

It will also be noted that the keep 42 has a conical imbricated upper section 72 as shown in FIG. 4, replacing the cranal roof as shown in FIG. 1.

The example of the structure shown in FIG. 7 also has additional barbican (outer defenses) located without the periphery of the example of the structure illustrated at FIG. 1. It will be appreciated that the barbican shown in FIG. 7 is by way of illustration only and that other configurations are possible. Each of the components comprising the barbican are simply sections of the integral base severed so as to be made into separate pieces in the many configurations. In the example shown, those pieces correspond to 20, 22, 34 and 38.

Having thus described the present invention by way of a practical example of modular structures, modifications of which will be apparent to those skilled in the art, what is claimed as new is as follows:

1. A modular model building structure comprising an integrally-formed base module having a plurality of walls connecting together a plurality of open cylindrical base sections, each open cylindrical base section having an inner surface of predetermined inner diameter and an outer surface of predetermined outer diameter, and at least one modular unit, said modular unit having spaced-apart projecting features formed integrally with its exterior surface, said projecting features engaging spaced apart notches on said walls to prevent said modular unit from accidental rotation said modular unit also having a solid cylindrical reduced diameter projection of said predetermined inner diameter size at the bottom edge of said modular unit for inserting said modular unit within the top of one of said open cylindrical base sections, wherein each of said modular units inserted into one of said open cylindrical base sections is removably locked in a predetermined position in relation to said one of said open cylindrical base sections by a transverse notch in said reduced diameter projection being engaged with a transverse rectangular ridge protruding at a right angle from said inner surface towards the center of said one of said open cylindrical base sections.

2. The modular model building structure of claim 1 wherein said modular unit is connected at its top to an identical modular unit by a notch in a reduced diameter projection of said identical modular unit such that when said identical modular unit is inserted into the top of said modular unit there is a communication of said notch with a ridge protruding from said inner surface of said modular unit thereby affixing said modular unit in one predetermined position in relation to said identical modular unit.

3. The modular model building structure of claim 1 wherein at least one of said walls has crenellated parapet with merlons spaced equal distances apart running along its upper edge.

4. The modular model building structure of claim 1 wherein at least one of said walls has an arch disposed along its bottom edge, said arch being in the form of a drawbridge.

5. The modular model building structure of claim 1 wherein at least one of said walls has a stairwell affixed to its lateral surface.

6. The modular model building structure of claim 1 wherein at least one of said walls has a chemin de ronde running along its upper surface.

7. The modular model building structure of claim 1 wherein at least one of said cylindrical base sections has molded windows in its exterior surfaces.

8. The modular model building structure of claim 1 wherein at least one of said cylindrical base sections has molded doors in its exterior surface.

9. The modular model building structure of claim 1 wherein at least one of said modular units has molded doors in its exterior surface.

10. The modular model building structure of claim 1 wherein at least one of said walls has at least one molded door in its lateral surface.

11. The modular model building structure of claim 1 further comprising a second type of modular unit being cylindrical in shape and being of said predetermined outer diameter and having crenellated parapet about is periphery and further having a reduced diameter portion of said predetermined inner diameter size.

12. The modular model building structure of claim 1 further comprising a third type of modular unit which is conical in shape and is molded with imbrication about its periphery and further having a reduced diameter portion of said predetermined inner diameter size.

13. The modular model building structure of claim 1 wherein said structure is molded of plastic.

14. A modular model building structure comprising an integrally-formed base module having walls joining open cylindrical base sections of predetermined inner diameter and pedetermined outer diameter, a plurality of cylindrical modular units each having said predetermined outer diameter and said predetermined inner diameter and further having a reduced diameter projection of said predetermined inner diameter size at the bottom edge of said cylindrical modular unit for inserting the cylindrical modular unit within the top of said open cylindrical base section wherein said cylindrical modular unit and said cylindrical base section are further interconnected by a slot in said reduced diameter projection of said cylindrical modular unit such that when said cylindrical modular unit is inserted into the top of said cylindrical base section there is a communication of said slot with a rectangular protrusion from the inner surface of said cylindrical base section thereby affixing said cylindrical modular unit in one position in relation to said cylindrical base section and wherein said rectangular protrusion from the inner surface of said cylindrical base section is in the form of a stairway affixed to said inner surface.

15. A modular building structure comprising an integrally-formed base module having walls joining open cylindrical base sections of predetermined inner diameter and predetermined outer diameter, a plurality of cylindrical modular units each having said predetermined outer diameter and said predetermined inner diameter and further having a reduced diameter projection of said predeterined inner diameter size at the bottom edge of said cylindrical modular unit for inserting the cylindrical modular unit within the top of said open cylindrical base section, an identical cylindrical modular unit also having a reduced diameter projection of said predetermined inner diameter size for inserting in the top of one of said cylindrical modular units wherin said cylindrical modular unit and said identical cylindrical modular unit are further interconnected by a slot in a reduced diameter projection of said identical cylindrical modular unit such that when said identical cylindrical modular unit is inserted into the top of said cylindrical modular unit there is a communication of said slot with a rectangular protrusion from the inner surface of said cylindrical modular unit thereby affixing said indentical cylindrical modular unit in one position in relation to said cylindrical modular unit and wherein said rectangular protrusion from the inner surface of said cylindrical modular unit is in the form of a stairway affixed to said inner surface.

16. A modular model building structure comprising an integrally-formed base module having a plurality of walls connecting together a plurality of open cylindrical base sections, each open cylindrical base section having an inner surface of predetermined inner diameter and an outer surface of predetermined outer diameter, at least one modular unit having a solid cylindrical reduced diameter projection of said predetermined inner diameter size at the bottom edge of said modular unit for inserting said modular unit within the top of one of said open cylindrical base sections, wherein each of said modular units inserted into one of said open cylindrical base sections is removably affixed in one predetermined position in relation to said one of said open cylindrical base sections by a transverse notch in said reduced diameter projection being engaged with a ridge protruding from said inner surface of said one of said open cylindrical base sections, wherein at least one of said modular units has at least one projecting window molded in its exterior surface, and wherein each of said projecting windows overhangs at least one roof module and locks each of said roof modules in place by interfering with abutments on said roof modules.

* * * * *